US005744296A

United States Patent [19]

Ishikawa et al.

[11] Patent Number: 5,744,296

[45] Date of Patent: Apr. 28, 1998

[54] SILVER HALIDE COLOR PHOTOGRAPHIC LIGHT-SENSITIVE MATERIAL

[75] Inventors: Sadayasu Ishikawa; Katsuhiko Suzuki, both of Hino, Japan

[73] Assignee: Konica Corporation, Japan

[21] Appl. No.: 768,128

[22] Filed: Dec. 17, 1996

[30] Foreign Application Priority Data

Dec. 20, 1905 [JP] Japan ..... 7-331774

[51] Int. Cl.[6] ..... G03C 1/005; G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 5,273,871 | 12/1993 | Takada et al. | 430/567 |
| 5,286,622 | 2/1994 | Waki | 430/567 |
| 5,320,937 | 6/1994 | Ihama | 430/567 |
| 5,470,698 | 11/1995 | Wen | 430/567 |
| 5,550,015 | 8/1996 | Karthauser | 430/569 |

FOREIGN PATENT DOCUMENTS 0428041 5/1991 European Pat. Off. ..... G03C 1/035

OTHER PUBLICATIONS

European Search Report EP 96 30 9279 and Annex.

*Primary Examiner*—Mark F. Huff

*Attorney, Agent, or Firm*—Jordan B. Bierman; Bierman, Muserlian and Lucas

[57] ABSTRACT

A silver halide color photographic material is disclosed, comprising a support having thereon a silver halide emulsion layer containing silver halide grains having a variation coefficient of grain size of 20% or less and at least 50% of the total grain projected area is accounted for by tabular grains having an aspect ratio of 5 or more; and the silver halide grains having an average silver iodide content of 4 mol % or more and a distinct core/shell structure comprising a core portion having a silver iodide content of 15 mol % or less, a shell portion having a silver iodide content of 8 mol % or more, and a surface phase having a silver iodide content higher than the average silver iodide content.

12 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material (hereinafter, referred to also as simply "light-sensitive material"), and more particularly to a high speed silver halide color photographic light-sensitive material excellent in graininess wherein pressure resistance has been improved.

BACKGROUND OF THE INVENTION

Recently, due to the proliferation of compact cameras, automatic focus single-lens reflex cameras and disposable cameras, development of a high speed silver halide color photographic light-sensitive material excellent in terms of image quality have been in strong demand. Accordingly, demands for improvements in performance of photographic silver halide emulsion has become increasingly stronger, and higher level performance of photographic materials such as higher speed, excellent graininess and excellent sharpness is requested.

To meet the above-mentioned requests, for example, U.S. Pat. Nos. 4,434,226, 4,439,520, 4,414,310, 4,433,048, 4,414,306 and 4,459,353 disclose technologies employing tabular silver halide grains (hereinafter, referred to simply as "tabular grains". It is known that aforesaid technologies have the following advantages. Namely, improvement of speed including improvement of color sensitization efficiency due to a sensitizing dye, improvement of speed and graininess, improvement of sharpness due to optical features intrinsic to tabular grains and improvement of covering power. However, the above-mentioned technologies are insufficient for meeting the high level demand in recent years, and still further improvement in terms of performance is demanded.

In relation to the steady stream of enhancement of speed and image quality, demand for improvement of pressure resistance in a silver halide color photographic light-sensitive material has further been increased, more than ever. Heretofore, improvement of pressure resistance has been studied, employing various means. Of these, the viewpoint that technologies to improve the anti-stress property of silver halide grains themselves is practically more preferable and more effective has been more influential. To meet the above-mentioned demands, emulsions composed of core/shell type silver halide grains having a silver iodobromide layer wherein silver iodide content is high have extensively been studied. Specifically, silver iodobromide emulsions containing core/shell grains having 10 mol % or more of a high silver iodide phase inside the grains have come to be taken remarkable notice of.

Japanese Patent O.P.I. Publication Nos. 59-99433, 60-35726 and 60-147727 disclose technologies to improve pressure resistance by means of core/shell type grains. Japanese Patent O.P.I. Publication Nos. 63-220238 and 1-201649 disclose improved technologies regarding high speed, graininess, pressure resistance and dependence of exposure intensity by introducing a dislocation line to silver halide grains. In addition, Japanese Patent O.P.I. Publication Nos. 63-220238 and 1-201649 disclose technologies wherein pressure resistance is improved by introducing multi-layered mono-dispersed tabular grains having a high iodide layer in the interim shell.

However, even the above technologies could not provide a high speed silver halide color photographic light-sensitive material excellent in graininess wherein pressure resistance has been improved, which can overcome high level requests in recent years.

SUMMARY OF THE INVENTION

In view of the foregoing, an objective of the present invention is to provide a high speed silver halide color photographic light-sensitive material excellent in graininess and improved in pressure resistance.

The above-mentioned object of the present invention is attained by the following constitution.

A silver halide color photographic light sensitive material comprising a support having thereon a silver halide emulsion layer, wherein said silver halide emulsion layer contains silver halide grain grains having a variation coefficient of grain size of 20% or less and at least 50% of the projected area of total silver halide grains is accounted for by tabular grains having an aspect ratio of 5 or more; and said silver halide grains have an average silver iodide content of 4 mol % or more and each comprise:

(1) a core portion having a silver iodide content of 15 mol % or less (2) a shell portion having a silver iodide content of 8 mol % or more, and (3) a surface phase having a silver iodide content higher than the average silver iodide content, and said tabular grains having a distinct core/shell structure.

DETAILED DESCRIPTION OF THE INVENTION

Silver halide grains contained in the silver halide emulsion of the present invention are tabular grains. In terms of crystallography, the tabular grains are classified as twinned crystal grains.

The twinned crystal refers to a silver halide crystal having one or more twinned planes with grain. Classification of the form of the twinned crystal is described in detail in Klein and Moisar, Photographische Korrespondenz Volume 99, p 100 and ibid, Volume 100, p. 57.

The tabular grains each preferably have two twin planes parallel to major faces. The twin planes can be observed through a transmission electron microscope. A practical method of observing the planes is as follows. Tabular grains are oriented to be in parallel with the major face on a support so that a sample is prepared. The sample is cut into a 0.1 μm intercept with a diamond cutter. The twin planes can be confirmed by observing the intercept with a transmission electron microscope.

When observing the intercept with a transmission electron microscope, 1000 or more tabular grains with cross section cut almost perpendicular to major faces are selected. The spacing between twin planes is measured for each grain. The resulting values are averaged out to obtain the twin plane spacing of the tabular grains.

In the present invention, the average twin plane spacing is preferably 0.01 to 0.05 μm, and more preferably 0.013 to 0.025 μm.

The twin plane spacing can be controlled by appropriately selecting the gelatin concentration, gelatin species, temperature, iodide concentration, pBr, pH, ion-supplying rate and stirring speed. In general, at the higher supersaturation condition the nuclei is formed, the narrower the twin plane spacing.

Details of supersaturating factors are referred to Japanese Patent O.P.I. Publication Nos. 63-92924 and 213637/1989.

In a similar manner, the thickness of the tabular grains of the present invention is measured by observing each intercept of the grains employing the transmission electron microscope to obtain an average thickness. The average thickness of the tabular grain is preferably 0.05–1.5 μm, and more preferably 0.07–0.50 μm.

The aspect ratio refers to a ratio of grain diameter to grain thickness, in which the diameter is that of a circle having the area equivalent to the grain projected area (equivalent circular diameter). The volume, diameter, aspect ratio and average value thereof of the grains can be determined according to the method described in Japanese Pat. O.P.I. Publication 8-171158.

In the invention, the tabular grains having an aspect ratio (i.e., grain size/grain thickness) of 5 or more account for 50% or more of the projected area of total silver halide grains contained in any one of the silver halide emulsion layers. Preferably, 60% or more of the total projected area is accounted for by tabular grains having an aspect ratio of 7 or more and more preferably, 70% or more of the total projected area is accounted for by tabular grains having an aspect ratio of 9 or more.

The grain size of the tabular grains of the present invention is represented in terms of the equivalent circular diameter of the silver halide grains. It is preferably 0.1–5.0 μm, and more preferably 0.2–2.0 μm.

The grain size can be determined by photographing the grains magnified by 10,000 to 70,000 times with an electron microscope, and then measuring the grain size or area when being projected on a print (the number of grains to be measured shall be an indiscriminate random sample of 1000 or more.).

An average grain size r is defined to be grain size ri when the product of frequency ni of grains having grain size ri and $ri^3$ (i.e., $ni \times ri^3$) is maximum (the effective digit is three and the minimum digit is rounded).

The silver halide emulsion containing the tabular grains is comprised of monodispersed grains. In the invention, the monodispersed silver halide emulsion is referred to as one having grain sizes within the average grain size r±20% accounts for 60% by weight or more of the total silver halide grains, more preferably 70% by weight or more and specifically more preferably 80% by weight or more.

In the case when the width of grain size distribution of the mono-dispersed emulsion of the invention is defined by the following relationship:

(standard deviation/average grain size)×100=grain size distribution (variation coefficient of grain size) [%], the grain size distribution of the tabular silver halide grains of the invention is 20% or less, preferably 15% or less and most preferably 10% or less. Here, the average grain size and the standard deviation shall now be calculated from the above-defined grain sizes, r and ri.

The tabular grains of the invention each comprise a core and a shell which covers the core. The shell is comprised of one or more layers.

The silver iodide content of the core of the tabular grains is less than 15 mol %, more preferably 13 mol % or less and still more preferably 10 mol % or less. Of the shell, the silver iodide content of at least one shell-layer is not less than 8 mol %, preferably not less than 10 mol % and more preferably not less than 15 mol %. In the invention the silver iodide content of the core is preferably less than that of the shell.

The core accounts for 1 to 60% by weight and more preferably, 4 to 40% by weight of the grain, based on the silver amount.

The silver halide grains relating to the invention have an average overall silver iodide content of 4 or more mol %, preferably 6 or more mol %, and still more preferably 8 to 12 mol %.

The silver halide grains are mainly comprised of silver iodobromide. However, other silver halide, such as silver chloride, may be contained, unless it deteriorates effects of the present invention.

The tabular grains relating to the invention are preferably prepared by causing seed grains to grow. Thus, an aqueous solution containing a protective colloid and previously prepared seed grains are introduced into a reaction vessel. The seed grains are grown by supplying silver ions, halide ions or optionally silver halide fine grains. Here, the seed grains can be prepared by mixing a water-soluble silver salt and water halide to for nucleus grains by a single jet method or a controlled double jet method and optionally subjecting the nucleus grains to Ostwald ripening. Halide composition of the seed grains can arbitrarily include silver bromide, silver iodide, silver chloride, silver iodobromide, silver iodochloride, silver bromochloride and silver bromochloride. Of these, silver bromide and silver iodide are preferable. In the case of silver iodobromide, the average silver iodide content is preferably 1 to 10 mol %.

When the silver halde grains are formed by growing the seed grains to form final grains, the central portion of the final grains may have a silver halide phase having different halide composition from the core portion. In addition, the seed preferably accounts for 50% or less, more preferably 30% or less and furthermore preferably 10% or less of the total silver halide of the grain, based on silver.

The distribution of the silver iodide content within the above-described core/shell type silver halide grain can be measured by a variety of physical measurement methods. For example, it can be determined by a measurement of low temperature luminescence or an X-ray diffractiometry as described in Annual Conference Summary of the Society of Japan Photographic science and Technology of Japan (1981).

The silver halide grains relating to the invention have a distinct core/shell structure. The distinct core/shell structure can be confirmed by the X-ray diffractiometry. Thus, the silver halide grains having a distinct core/shell structure provides a diffraction curve having two peaks corresponding to the core and the shell, in the range of 71°–74° of a diffraction angle (2θ) measured by the X-ray diffractiometry described hereinafter.

When a diffraction pattern of the (420) plane of the silver halide is measured by means of a powder X-ray method at a tube voltage of 40 kV and a tube current of 100 mA using Cu as the target and a Kα-ray of Cu as a radiation source, if emulsion grains have a distinct core/shell structure, a diffraction curve having two maximums of a diffraction peak corresponding to the core and a diffraction peak corresponding to the shell in a range of 71°–74° of a diffraction angle (2θ) is obtained. Here, the expression, "having two maximums (peaks)" means that a ratio of the minimum intensity between two peaks to a lower peak intensity is 0.9 or less and preferably 0.7 or less. When the two peak intensities are compared, the diffraction intensity of the peak corresponding to the shell is preferably 1/1 to 20/1, and more preferably 2/1 through 15/1 of the diffraction intensity of the peak corresponding to core.

A layer other than the core and shell (hereinafter, denoted as an intermediate layer) may exist between the core portion and the shell portion as long as it does not substantially affect on the form of two peaks corresponding to the high iodide portion and the low iodide portion, when the above-mentioned X-ray diffraction pattern is measured. The intermediate layer is not limitative with respect to the location, number and silver iodide content thereof.

As a means for forming the silver halide grains relating to the invention, there can be applicable various conventional methods known in the art, such as a single jet method, controlled double jet method and controlled triple jet method. In order to obtain highly monodispersed grains, it is important to control pAg in the liquid phase in which silver halide grains are produced in accordance with the growing rate of silver halide grains. The pAg value is 7.0 to 11.0, preferably 7.5 to 10.5 and more preferably 8.0 to 10.0.

The determination of the flowing rate is referred to Japanese Patent O.P.I. Publication Nos. 54-48521 and 58-49938.

When manufacturing the tabular grains of the present invention, conventional silver halide solvents such as ammonia, thioether and thiourea may be present. The silver halide solvents may not be used.

The silver halide grains used in the invention may be any of those wherein a latent image is mainly formed on the surface of the grains or may also be those wherein the latent image is formed inside the grains. Of these, the surface latent image forming type silver halide grains are preferred.

The silver halide grains are manufactured in the presence of a dispersion medium, i.e., in a solution containing the dispersion medium. Here, "an aqueous solution containing the dispersion medium" is referred to as an aqueous solution wherein a protective colloid is formed employing a material capable of constituting a hydrophilic colloid such as gelatin (a material usable as a binder). An aqueous solution containing a colloidal protective gelatin is preferred.

When gelatin is used as the above-mentioned protective colloid in embodiments of the invention, the gelatin may be either a lime-processed gelatin or an acid-processed gelatin. Details of the manufacturing method of the gelatin are described in Arthur Veis, "The Macromolecular Chemistry of Gelatin" (published by Academic Press, 1964).

As a hydrophilic colloid usable as a protective colloid other than the gelatin, for example, gelatin derivatives, a graft polymer of the gelatin and other polymers, proteins such as albumin and casein; cellulose derivatives such as hydroxyethyl cellulose, carboxymethyl cellulose and cellulose ester sulfate and sugar derivatives such as sodium alginate and starch derivatives; various synthetic hydrophilic polymers such as a homopolymer or copolymers of polyvinyl alcohol, polyvinyl alcohol-partial acetal, poly-N-vinyl pyrrolidone, polyacrylic acid, polymethacrylic acid, polyacrylamide, polyvinyl imidazole and polyvinyl pyrazole are cited.

Gelatins having a jelly strength of 200 or more, based on the PAGI method are preferably used.

To the silver halide grains, in the course of nucleation and/or growth of the grains, metallic ion may be added using at least one selected from cadmium salt, zinc salt, lead salt, thallium salt, iron salt, rhodium salt, iridium salt and indium salt (including their complex salts) so that the metal ions may be incorporated inside the grain and/or near the surface of the grain.

After completion of the growth of the silver halide grains, unnecessary soluble salts may be removed or they may be kept incorporated.

In addition, as described in Japanese Patent O.P.I. Publication No. 60-138538, desalting may be conducted at an arbitrary point during growth of the silver halide grains. For removing the salts, methods described in Research Disclosure (hereinafter, abbreviated as RD) No. 17643, Item II may be employed.

In order to remove the soluble salts from the emulsion after completion of precipitation is formed or after physical ripening, there may be applicable a noodle washing method in which gelatin is gelled or a sedimentation method (a flocculation method), utilizing an inorganic salts, anionic surfactants, anionic polymers (e.g., polystyrene sulfonic acid) or gelatin derivatives (e.g., acyl-gelatin and carbamoyl-gelatin).

In the present invention, the silver iodide content of individual silver halide grains and the average silver halide content of overall silver halide grains can be determined by the EPMA method (Electron Probe Micro Analyzer method). In this method, a sample in which emulsion grains are well-dispersed so that none of them are in contact with each other is prepared and subjected to the X-ray analysis by means of an electron beam excitation to determine element (s) present in an extremely fine portion. In this method, the halide composition of silver halide can be determined by measuring specific X-ray intensities of silver and iodide of the grain. At least 50 grains are subjected to the EPMA measurement to determine the average silver iodide content.

The silver halide grains relating to the invention preferably have a uniform silver iodide content among the grains. When the distribution of the silver iodide content among the grains is measured by means of the EPMA method, the relative standard deviation is preferably 30% or less and more preferably 20% or less.

The surface phase of the silver halide grains of the invention is defined as an outermost layer of the grain including the outermost surface of the grain and having a depth of 50 Å from the outermost surface of the grain. The halide composition of the surface phase of the tabular grain can be determined by means of the XPS method (X-ray Photoelectron Spectroscopy method) as follows.

Thus, the sample was cooled down to −110° C. or lower under a ultra-high vacuum condition of $1\times10^{-8}$ torr. or less. As an X-ray for probing, MgKα ray was irradiated at an X-ray source voltage of 15 kV and an X-ray source electrical current of 40 mA, and measurements with respect to electrons of Ag3d5/2, Br3d and I3d3/2 were made. The integrated intensity of the peak measured was corrected with sensitivity factor. From the intensity ratio, the halide composition near the surface was determined.

The XPS method is known as a method for determining the silver iodide content on the surface of the silver halide grain, as disclosed in Japanese Patent O.P.I. Publication No. 2-24188. However, when the measurement is conducted at room temperature, the sample is destroyed due to X-ray irradiation. Accordingly, the silver iodide in the outermost layer could not be accurately measured. The present inventors succeeded in accurately determining the silver iodide content in the outermost layer by cooling the sample to the temperature where no destruction occurred. As a result, it was discovered that, in the case of grains having different components between the surface and the interior portion, such as a core/shell grain and grains having a high iodide layer or a low iodide layer localized on the outermost surface, the value measured at room temperature is proved to be noticeably different from the actual composition, due to decomposition of the silver halide caused by X-ray irradiation and the diffusion of the halide (specifically of iodide).

The XPS method used here is carried out as follows.

To the emulsion, an aqueous 0.05 wt % protein-decomposable enzyme (proteinase) was added, and the mixture was stirred for 30 minutes at 45° C. to hydrolyze the gelatin. The resulting mixture was subjected to centrifugal separation so that emulsion grains were precipitated, and then the supernatant was decanted. Next, distilled water was added thereto and the emulsion grains were dispersed in the distilled water, and then subjected to centrifugal separation, followed by decantation of the supernatant. The emulsion grains were re-dispersed, and then thinly coated on a mirror-polished silicone wafer to make a measurement sample. Using the sample thus-prepared, the surface iodide was measured by means of the XPS method. In order to prevent breakage of a sample due to the X-ray irradiation, the sample was cooled to −110° to −120° C. in a chamber for the XPS measurement. As the X-ray for probing, MgKα-ray was irradiated at the X-ray source voltage of 15 kV and the X-ray source electrical current of 40 mA, and electrons in Ag3d5/2, Br3d and I3d3/2 were respectively measured. The integrated intensity of the peak measured was corrected with sensitivity factor. From the intensity ratio, the halide composition near the surface was determined.

The silver halide grains of the invention satisfies relationship that the silver iodide content of the surface phase of the grain is higher than the average silver iodide content of the grains. A ratio of the silver iodide content of the surface phase of the grain to the average overall silver iodide content is preferably 1.3 to 30, and more preferably 1.5 to 15.

The silver halide grains relating to the invention may be subjected to chemical sensitization in accordance with conventional methods. Sulfur sensitization, selenium sensitization and a noble metal sensitization employing gold and other noble metals may be applicable singly or in combination thereof.

The silver halide grains relating to the invention may be spectrally sensitized to a desired wavelength region by the use of dyes known as a sensitizing dye in the art. The sensitizing dye may be used singly, or in combination. Together with the sensitizing dye, a dye which does not have spectral sensitizing ability or a super sensitizer which enhances sensitization effect of the sensitizing dye may be incorporated in emulsions.

To the silver halide emulsions used in the invention, an anti-fogging agent or a stabilizer may be incorporated. Gelatin is advantageously used as a binder. Emulsion layers and other hydrophilic colloidal layers may be hardened. In addition, a plasticizer and water-insoluble or water-soluble synthetic polymer dispersion (latex) may be incorporated therein.

In emulsion layers in the silver halide color photographic light-sensitive material containing the tabular grain of the present invention, couplers are used. In addition, a competing coupler having color correction effect and compound which releases a photographically useful fragment upon coupling with an oxidation product of a color developing agent, such as a development accelerator, a developing agent, a silver halide solvent, a color-toning agent, a hardener, a fogging agent, an anti-fogging agent, a chemical sensitizer, a spectral sensitizer and a desensitizer may be used.

In a light-sensitive material containing the tabular grain of the present invention, auxiliary layers such as a filter layer, an anti-halation layer and an anti-irradiation layer may be provided. In the layers and/or emulsion layers, a dye capable of being dissolved out of in the light-sensitive material or being bleached during photographic processing may be incorporated.

Furthermore, a matting agent, a lubricant, an image stabilizer, a formalin scavenger, a UV absorber, a fluorescent brightening agent, a surfactant, a development accelerator and a development retardant may be incorporated in the photographic light-sensitive material of the invention.

As a support, paper laminated with polyethylene, polyethylene terephthalate film, baryta paper and triacetate cellulose may be employed.

EXAMPLE

Hereinafter, the present invention will be explained exemplarily referring to the following examples of the present invention. However, the present invention is not limited thereto.

Example 1

Preparation of twinned crystal seed grain emulsion T-1

In accordance with the procedure described below, a seed emulsion having two parallel twin planes was prepared.

| | |
|---|---|
| (Solution A) | |
| Ossein gelatin | 24.2 g |
| Potassium bromide | 10.75 g |
| Nitric acid (1.2N) | 118.6 ml |
| A 10 wt % methanol solution of $HO(CH_2CH_2O)_m$-$(C(CH_3)HCH_2O)_{19.8}(CH_2CH_2O)_nH$ (m + n = 9.77) | 6.78 ml |
| Distilled water was added to make 9686 ml. | |
| (Solution B) | |
| Silver nitrate | 1200.0 g |
| Distilled water was added to make 2826 ml. | |
| (Solution C) | |
| Potassium bromide | 823.8 g |
| Potassium iodide | 23.46 g |
| Distilled water was added to make 2826 ml. | |
| (Solution D) | |
| Ossein gelatin | 120.9 g |
| Distilled water was added to make 2130 ml. | |
| (Solution E) | |
| Potassiuin bromide | 76.48 g |
| Distilled water was added to make 376 ml. | |
| (Solution F) | |
| Potassium hydroxide | 10.06 g |
| Distilled water was added to make 340 ml. | |

To Solution A which was vigorously stirred at 35° C., 464 ml of Solution B and 464 ml of Solution C were added for a period of 2 minutes by a double jet method to form nucleus grains. In the meanwhile, Solution E was used as necessary in order to keep pAg at 9.82.

Following this, the temperature of the mixture solution was raised to 60° C. taking 66 minutes. During raising the temperature, when the temperature in the reacting solution was raised to 55° C., Solution D was independently added for a period of 7 minutes. In addition, when the temperature was raised to 60° C., Solution F was added for 1 minute. Subsequently, 2362 ml of Solution B and 2362 ml of Solution C were added taking 43 minutes. Since immediately after the start of the temperature rise, pAg was kept at 8.97 employing Solution E.

After completing addition of Solutions B and C, the resulting solution was subjected to desalting in accordance with conventional methods. To the emulsion, after desalting, a 10 wt % aqueous gelatin solution was added. After the emulsion was stirred and dispersed for 30 minutes at 55° C., distilled water was added thereto to make up 5360 g of emulsion.

When the seed emulsion grains were observed through an electron microscope, it was found that grains were tabular grains having two twinned surfaces which were parallel each other.

The thus prepared seed emulsion grains were proved to have an average grain size of 0.445 μm, grains having an aspect ratio of 5.0 or more accounting for 50% of the total projection area.

Preparation of emulsion EM-1 of the invention

Tabular grain emulsion EM-1 of the invention was prepared employing 6 kinds of solutions (Solution A includes seed emulsion T-1) as below.

| | |
|---|---|
| (Solution A) | |
| Ossein gelatin | 163.4 g |
| A 10 wt % methanol solution of $HO(CH_2CH_2O)_m(C(CH_3)HCH_2O)_{19.8}(CH_2CH_2O)_nH$ (m + n = 9.77) | 2.50 ml |
| Seed emulsion (T-1) | 674.50 g |
| Potassium bromide | 3.0 g |
| Distilled water was added to make 3500 ml. | |
| (Solution B) | |
| Silver nitrate | 2581.7 g |
| Distilled water was added to make 4342 ml. | |
| (Soiltion C) | |
| Potassium bromide | 1828.3 g |
| Distilled water was added to make.4390 ml. | |
| (Solution D) | |
| An aqueous potassium bromide solution (1.75N) | |
| (Solution E) | |
| An aqueous acetic acid solution (56 wt %) | |
| (Solution F) | |
| A fine grain emulsion comprised of 3 wt % of gelatin and silver iodide grains (at an average grain size of 0.05 μm) (*) | 2793 g |

(*) It was prepared as follows. Thus, in 5000 ml of a 6.0 wt % of gelatin solution containing 0.06 mol of potassium iodide, 2000 ml of 7.06 mol of silver nitrate and 2000 ml of an aqueous solution containing 7.06 mol of potassium iodide were added taking 10 minutes. The pH and temperature during formation of the fine grains were respectively controlled to 2.0° and 40° C. After forming the grains, the pH was adjusted to 6.0 employing an aqueous sodium carbonate. The finished weight was 12.53 kg.

While vigorously stirring Solution A kept at 75° C., Solutions B, C and F were added thereto by a triple jet method or a single jet method in accordance with combinations shown in Table 1 so that seed crystals were grown and thereby tabular silver halide emulsions were prepared.

Here, the addition flow rate of Solutions B, C and F by the triple jet method and that of Solution F by the single jet method were acceleratedly varied so as to meet the critical growth speed of the silver halide grains. In addition, in order to prevent the creation of small grains other than the seed crystal grains during growth and also to prevent polydispersion due to Ostwald ripening, the flow rate was appropriately controlled, as shown in Table 1.

In addition, throughout crystal growth region, the pAg and pH were controlled. In order to control the pAg and pH, Solutions D and E were added as necessary.

After the growth of the grains, the grains were subjected to desalting in accordance with a method described in Japanese Patent O.P.I. Publication No. 5-72658. Following this, gelatin was added. At 40° C., the pH and pAg were respectively regulated to 5.80 and 8.06.

By electron microscopic observation of the resulting emulsion grains, it was found that the resulting grains were tabular grains having an average grain size (the mean value of the diameter of the projected area in conversion to a circle, i.e., equivalent circular diameter), an average aspect ratio (tabular grains with the average aspect ratio or more accounting for 70% of the total projected area) and a variation coefficient of grain size distribution were respectively 1.348 μm, 7.0 and 18.0%, respectively.

TABLE 1

| Mixing Time (min) | Flow Rate for Adding Solution B (ml/min.) | Flow Rate for Adding Solution C (ml/min.) | Flow Rate for Adding Solution F (ml/min.) | pH | pAg | Mixing Temperature (°C.) |
|---|---|---|---|---|---|---|
| 0.0 | 7.8 | 7.5 | 3.8 | 4.0 | 8.4 | 75 |
| 23.2 | 9.9 | 9.5 | 4.8 | 4.0 | 8.4 | 75 |
| 45.5 | 12.3 | 11.8 | 6.0 | 4.0 | 8.4 | 75 |
| 85.7 | 15.1 | 14.5 | 7.4 | 4.0 | 8.4 | 75 |
| 102.1 | 16.1 | 15.5 | 7.9 | 4.0 | 8.4 | 75 |
| 120.5 | 17.2 | 16.5 | 8.4 | 4.0 | 8.4 | 75 |
| 141.2 | 18.4 | 17.6 | 9.0 | 4.0 | 8.4 | 75 |
| 164.3 | 19.6 | 18.7 | 9.6 | 4.0 | 8.4 | 75 |
| 190.2 | 22.8 | 32.7 | 10.2 | 4.0 | 8.4 | 75 |
| 190.3 | 0.0 | 0.0 | 266.0 | 4.0 | 8.4 | 75 |
| 192.3 | 0.0 | 0.0 | 266.0 | 4.0 | 9.4 | 75 |
| 192.4 | 9.6 | 12.0 | 3.8 | 4.0 | 9.4 | 75 |
| 202.7 | 76.7 | 82.1 | 30.2 | 4.0 | 9.4 | 75 |
| 204.7 | 83.0 | 89.0 | 31.7 | 4.0 | 9.4 | 75 |
| 204.8 | 83.4 | 89.2 | 13.6 | 4.0 | 9.4 | 75 |
| 213.0 | 87.1 | 93.2 | 14.2 | 4.0 | 9.4 | 75 |

Preparation of emulsions EM-2–EM-4 of the invention

Emulsion EM-2 was prepared in the same manner as in Emulsion EM-1 except that pAg was changed to 10.0 at and after 192.3 minute since mixing time was started and that the addition flow rate of each reaction solution was also acceleratedly changed meeting the growth speed. By observing the resulting emulsion grains with a scanning type electron microscope, it was found that the resulting grains were tabular grains having an average grain size, the aspect ratio and a variation coefficient of grain size distribution of 1.618 μm, 12.0 and 18.5%, respectively.

Emulsion EM-3 was prepared in the same manner as in Emulsion EM-1 except that the addition flow rate of each reacting solution during forming shell was acceleratedly changed. By observing the resulting emulsion grains with a scanning type electron microscope, it was found that the resulting grains were tabular grains having an average grain size, aspect ratio and a variation coefficient of grain size distribution of 1.348 μm, 7.0 and 18.2%, respectively.

Emulsion EM-4 was prepared in the same manner as in Emulsion EM-1 except that the addition flow rate of each reacting solution was functionally changed. By observing the resulting emulsion grains with a scanning type electron microscope, it was found that the resulting grains were tabular grains having an average grain size, an aspect ratio and a variation coefficient of grain size distribution of 1.350 μm, 7.2 and 19.0%, respectively.

Preparation of comparative emulsions EM-5–EM-8

Emulsion EM-5 having the same silver iodide content of the core and shell was prepared in the same manner as in Emulsion EM-1 except that the addition flow rate of each reaction solution was acceleratedly changed. By observing the resulting emulsion grains with a scanning type electron microscope, it was found that the resulting grains were tabular grains having an average grain size, an aspect ratio and a variation coefficient of grain size distribution of 1.349 μm, 7.0 and 18.0%, respectively.

Emulsion EM-6 having a low aspect ratio was prepared in the same manner as in Emulsion EM-1 except that pAg was constantly controlled at 8.2 since start of mixing. By observing the resulting emulsion grains with a scanning type electron microscope, it was found that the resulting grains were tabular grains having an average grain size, an aspect ratio and a variation coefficient of grain size distribution of 1.118 μm, 4.0 and 19.0%, respectively.

Emulsion EM-7 having a wider grain size distribution was prepared in the same manner as in Emulsion EM-1 except that the addition flow rate of each reaction solution was changed and that the mixing time was extended by 1.5 times.

By observing the resulting emulsion grains with a scanning type electron microscope, it was found that the resulting grains were tabular grains having an average grain size, an aspect ratio and a variation coefficient of grain size distribution of 1.342 μm, 6.7 and 26.0%, respectively.

Emulsion EM-8 having a higher silver iodide content in core compared to silver iodide content in shell was prepared in the same manner as in Emulsion EM-1 except that the addition flow rate of each reacting solution was changed. By observing the resulting emulsion grains with a scanning type electron microscope, it was found that the resulting grains were tabular grains having an average grain size, an aspect ratio and a variation coefficient of grain size distribution of 1.349 μm, 7.0 and 19.0%, respectively.

Thus prepared emulsions EM-1 to EM-8 are summarized in Table 2, with respect to halide compositions and grain structure. Of these, it was proved that, in emulsion EM-6, the grain projected area accounted for by tabular grains having an aspect ratio of 5 or more was less than 50% of the total grain projected area. In emulsions other than EM-6, tabular grains having the aspect ratio of 5 or more were proved to account for more than 50% of the total grain projected area. Particularly, in emulsion EM-2, tabular grains having the aspect ratio of 9 or more accounted for more than 50% of the total grain projected area.

TABLE 2

| Emulsion No. | Aspect Ratio* (Projected Area %**) | Grain Size Distribution (%) | Core's Silver Iodide Content (mol %) | Shell's Silver Iodide Content (mol %) | There is a Clear Structure (yes/no) | Average Silver Iodide Content (mol %) | Surface Iodide Ratio (mol %) | Surface Iodide Ratio/ Average Iodide Ratio |
|---|---|---|---|---|---|---|---|---|
| EM-1 | 7.0 (70) | 18.0 | 8.5 | 35 | yes | 9.06 | 15.03 | 1.66 |
| EM-2 | 12.0 (70) | 18.5 | 8.5 | 35 | yes | 9.06 | 16.01 | 1.77 |
| EM-3 | 7.0 (70) | 18.2 | 8.5 | 20 | yes | 9.06 | 11.05 | 1.22 |
| EM-4 | 7.2 (70) | 19.0 | 11.0 | 14 | yes | 9.06 | 9.67 | 1.10 |
| EM-5 | 7.0 (70) | 18.0 | 7.0 | 7 | no | 6.5 | 7.48 | 1.15 |
| EM-6 | 4.0 (70) | 19.0 | 8.5 | 35 | yes | 9.06 | 10.08 | 1.11 |
| EM-7 | 6.7 (70) | 26.0 | 8.5 | 35 | yes | 9.06 | 10.78 | 1.19 |
| EM-8 | 7.0 (70) | 19.0 | 30.0 | 5 | yes | 9.06 | 7.34 | 0.81 |

*Average aspect ratio

**Projected area ratio of tabular grains having an aspect ratio of not less than the average aspect ratio

Example 2

Preparation of light-sensitive material samples

Emulsions EM-1 through EM-8 were subjected optimally to sulfur-gold chemical sensitization. Employing the emulsions, each layer having the following composition was formed on a triacetyl cellulose film support in the following order from the support side so that a multi-layered color photographic light-sensitive material was prepared.

The addition amounts in a silver halide color photographic light-sensitive material were the gram number per 1 $m^2$ unless otherwise noted. Silver halide and colloidal silver were represented in conversion to silver. Sensitizing dyes were represented by mol number per mol of silver halide.

The constitution of multi-layered color photographic light-sensitive material sample 101 (employing emulsion EM-1 of the present invention) is as follows.

| Sample 101 | |
|---|---|
| 1st layer: Anti-halation layer | |
| Black colloidal silver | 0.16 |
| UV-absorber (UV-1) | 0.20 |
| High boiling solvent (OIL-1) | 0.16 |
| Gelatin | 1.60 |
| 2nd layer: Intermediate layer | |
| Compound (SC-1) | 0.14 |
| High boiling solvent (OIL-2) | 0.17 |
| Gelatin | 0.80 |
| 3rd layer: Low speed red sensitive layer | |
| Silver iodobromide emulsion A | 0.15 |
| Silver iodobromide emulsion B | 0.35 |
| Sensitizing dye (SD-1) | $2.0 \times 10^{-4}$ |
| Sensitizing dye (SD-2) | $1.4 \times 10^{-4}$ |
| Sensitizing dye (SD-3) | $1.4 \times 10^{-5}$ |
| Sensitizing dye (SD-4) | $0.7 \times 10^{-4}$ |
| Cyan coupler (C-1) | 0.53 |
| Colored cyan coupler (CC-1) | 0.04 |
| DIR compound (D-1) | 0.025 |
| High boiling solvent (OIL-3) | 0.48 |
| Gelatin | 1.09 |

-continued

| Sample 101 | |
|---|---|
| 4th layer: Mid-speed red sensitive layer | |
| Silver iodobromide emulsion B | 0.30 |
| Silver iodobromide emulsion C | 0.34 |
| Sensitizing dye (SD-1) | $1.7 \times 10^{-4}$ |
| Sensitizing dye (SD-2) | $0.86 \times 10^{-4}$ |
| Sensitizing dye (SD-3) | $1.15 \times 10^{-5}$ |
| Sensitizing dye (SD-4) | $0.86 \times 10^{-4}$ |
| Cyan coupler (C-1) | 0.33 |
| Colored cyan coupler (CC-1) | 0.013 |
| DIR compound (D-1) | 0.02 |
| High boiling solvent (OIL-1) | 0.16 |
| Gelatin | 0.79 |

-continued

| Sample 101 | |
|---|---|
| 5th layer: High speed red sensitive layer | |
| Silver iodobromide emulsion D | 0.95 |
| Sensitizing dye (SD-1) | $1.0 \times 10^{-4}$ |
| Sensitizing dye (SD-2) | $1.0 \times 10^{-4}$ |
| Sensitizing dye (SD-3) | $1.2 \times 10^{-5}$ |
| Cyan coupler (C-2) | 0.14 |
| Colored cyan coupler (CC-1) | 0.016 |
| High boiling solvent (OIL-1) | 0.16 |
| Gelatin | 0.79 |
| 6th layer: Intermediate layer | |
| Compound (SC-1) | 0.09 |
| High boiling solvent (OIL-2) | 0.11 |
| Gelatin | 0.80 |
| 7th layer: Low speed green sensitive layer | |
| Silver iodobromide emulsion A | 0.12 |
| Silver iodobromide emulsion B | 0.38 |
| Sensitizing dye (SD-4) | $4.6 \times 10^{-5}$ |
| Sensitizing dye (SD-5) | $4.1 \times 10^{-4}$ |
| Magenta coupler (M-1) | 0.14 |
| Magenta coupler (M-2) | 0.14 |
| Colored magenta coupler (CM-1) | 0.06 |
| High boiling solvent (OIL-4) | 0.34 |
| Gelatin | 0.70 |
| 8th layer: Intermediate layer | 0.41 |
| Gelatin | |
| 9th layer: Middle speed green sensitive layer | |
| Silver iodobromide emulsion B | 0.30 |
| Silver iodobromide emulsion C | 0.34 |
| Sensitizing dye (SD-6) | $1.2 \times 10^{-4}$ |
| Sensitizing dye (SD-7) | $1.2 \times 10^{-4}$ |
| Sensitizing dye (SD-8) | $1.2 \times 10^{-4}$ |
| Magenta coupler (M-1) | 0.04 |
| Magenta coupler (M-2) | 0.04 |
| Colored magenta coupler (CM-1) | 0.017 |
| DIR compound (D-2) | 0.025 |
| DIR compound (D-3) | 0.002 |
| High boiling solvent (OIL-5) | 0.12 |
| Gelatin | 0.50 |
| 10th layer: High speed green sensitive layer | |
| Emulsion EM-1 of the present invention | 0.95 |
| Sensitizing dye (SD-6) | $7.1 \times 10^{-5}$ |
| Sensitizing dye (SD-7) | $7.1 \times 10^{-5}$ |
| Sensitizing dye (SD-8) | $7.1 \times 10^{-5}$ |
| Magenta coupler (M-1) | 0.09 |
| Colored magenta coupler (CM-1) | 0.011 |
| High boiling solvent (OIL-4) | 0.11 |
| Gelatin | 0.79 |
| 11th layer: Yellow Filter layer | |
| Yellow colloidal silver | 0.08 |
| Compound (SC-1) | 0.15 |
| High boiling solvent (OIL-2) | 0.19 |
| Gelatin | 1.10 |
| 12th layer: Low speed blue sensitive layer | |
| Silver iodobromide emulsion A | 0.12 |
| Silver iodobromide emulsion B | 0.24 |
| Silver iodobromide emulsion C | 0.12 |
| Sensitizing dye (SD-9) | $6.3 \times 10^{-5}$ |
| Sensitizing dye (SD-10) | $1.0 \times 10^{-5}$ |

-continued

| Sample 101 | |
|---|---|
| Yellow coupler (Y-1) | 0.50 |
| Yellow coupler (Y-2) | 0.50 |
| DIR compound (D-4) | 0.04 |
| DIR compound (D-5) | 0.02 |
| High boiling solvent (OIL-2) | 0.42 |
| Gelatin | 1.40 |
| 13th layer: High speed blue sensitive layer | |
| Silver iodobromide emulsion C | 0.15 |
| Silver iodobromide emulsion E | 0.80 |
| Sensitizing dye (SD-9) | $8.0 \times 10^{-5}$ |
| Sensitizing dye (SD-11) | $3.1 \times 10^{-5}$ |
| Yellow coupler (Y-1) | 0.12 |
| High boiling solvent (OIL-2) | 0.05 |
| Gelatin | 0.79 |
| 14th layer: First protective layer | |
| Silver iodobromide emulsion (with an average grain size of 0.08 μm and a silver iodide content of 1.0 mol %) | 0.40 |
| UV absorber (UV-1) | 0.065 |
| High boiling solvent (OIL-1) | 0.07 |
| High boiling solveht (OIL-3) | 0.07 |
| Gelatin | 0.65 |
| 15th layer: Second protective layer | |
| Alkaline-solubilizing matting agent (with an average grain size of 2 μm) (PM-1) | 0.15 |
| Polymethylmethacrylate (average grain sixe: 3 μm) | 0.04 |
| Lubricant (WAX-1) | 0.04 |
| Gelatin | 0.55 |

In addition to the above components, coating aid Su-1, dispersion aid Su-2, viscosity regulator, hardeners H-1 and H-2, stabilizer ST-1, anti-foggant AF-1, two kinds of AF-2 whose average molecular weights were respectively 10,000 and 1,100,000 and anti-mold agent DI-1 were added.

The emulsions used for the above sample were as follows. Each emulsion was optimally subjected to gold and sulfur chemical sensitization. The terms, "diameter" and "thickness" in Table 3 are respectively a diameter and thickness of silver halide grains in each emulsion.

TABLE 3

| Emulsion | Average AgI content (mol %) | Average grain size (μm) | Crystal habit | Diameter/ thickness ratio |
|---|---|---|---|---|
| Emulsion A | 4.0 | 0.41 | Regular crystal | 1 |
| Emulsion B | 6.0 | 0.57 | Regular crystal | 1 |
| Emulsion C | 6.0 | 0.75 | Regular crystal | 1 |
| Emulsion D | 6.0 | 1.16 | Twinned tabular | 4 |
| Emulsion E | 6.0 | 1.30 | Twinned tabular | 4 |

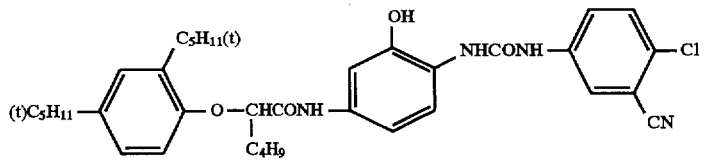

-continued
C-2
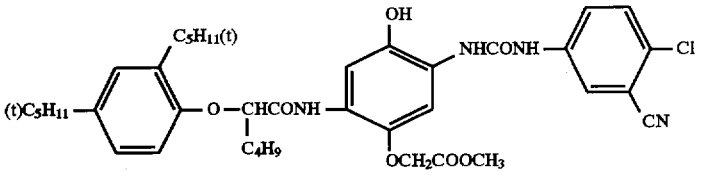
M-1
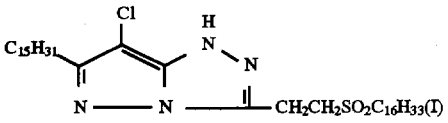
M-2
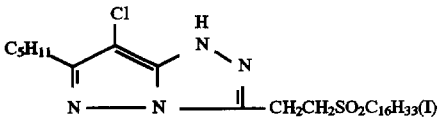
Y-1
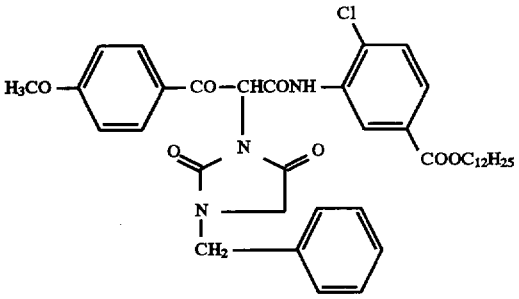
Y-2
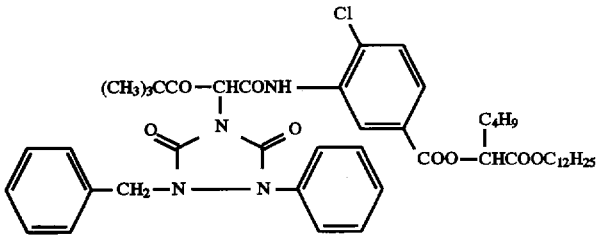
CC-1
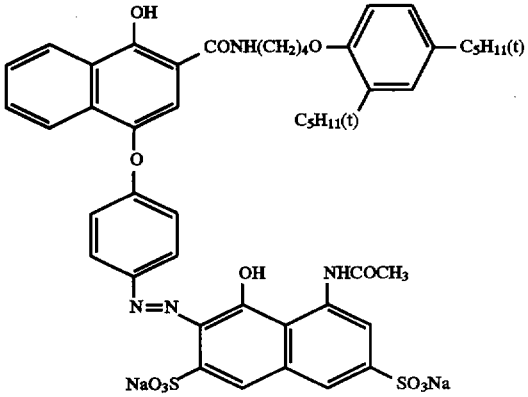

-continued
CM-1
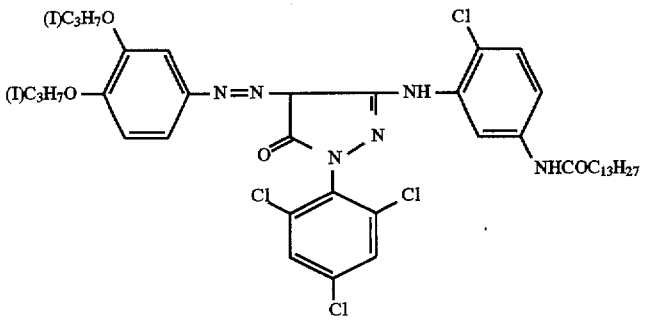
CM-2
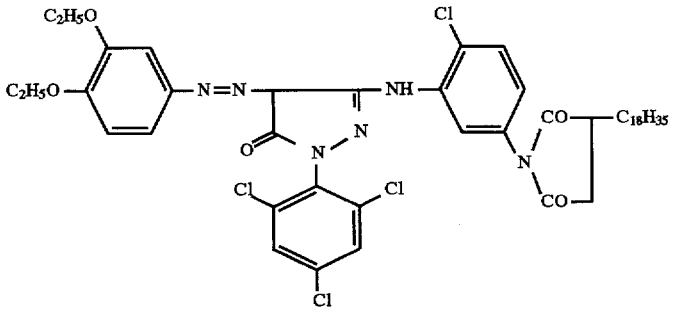
D-1
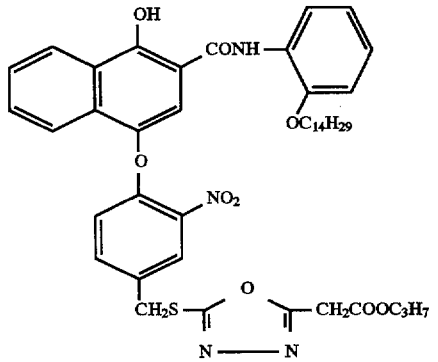
D-2
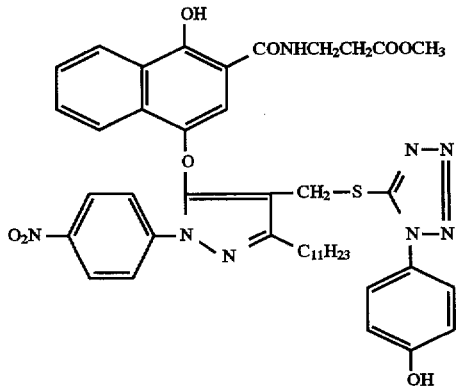

-continued
D-3
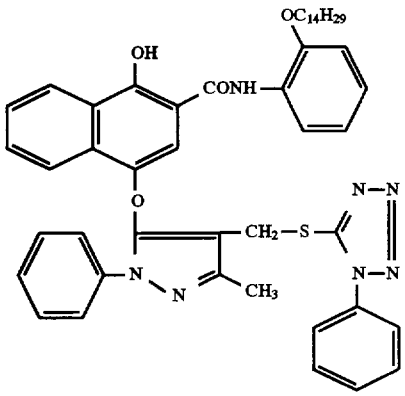
D-4
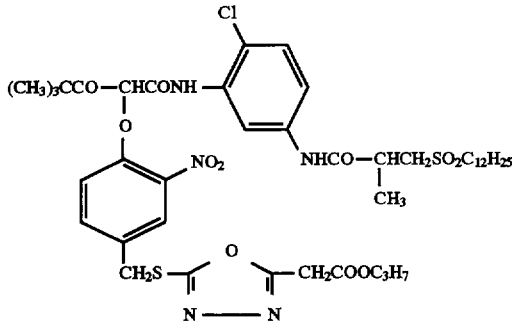
D-5
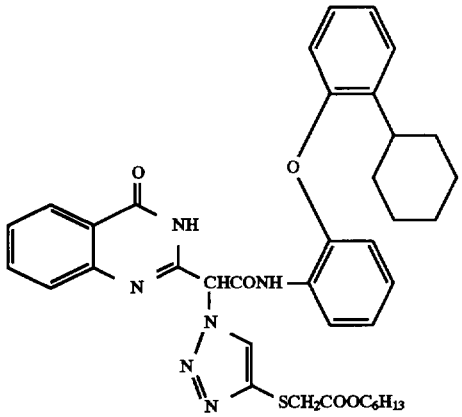
D-6
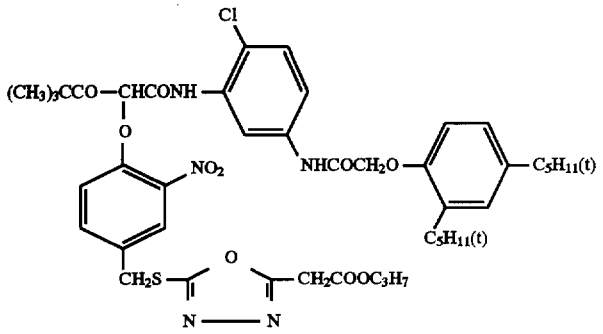
OIL-1
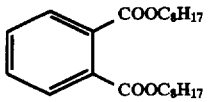
OIL-2
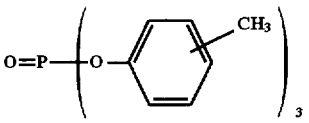

-continued
OIL-3
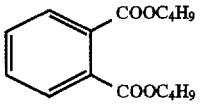
OIL-4
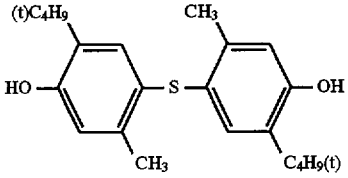
OIL-5
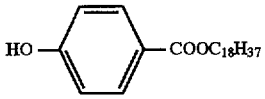
SC-1
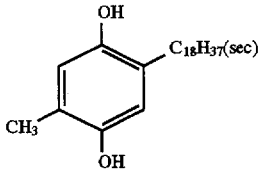
UV-1
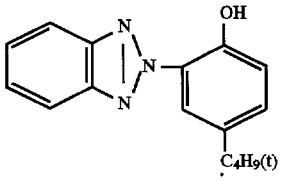
WAX-1
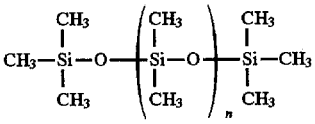
Average molecular weight by weight Mw = 3,000
Su-1
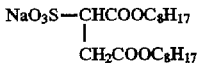
Su-2
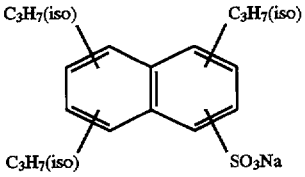
SD-1
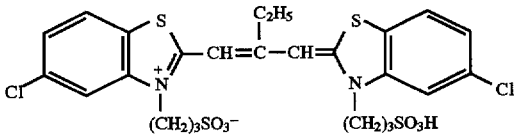
SD-2
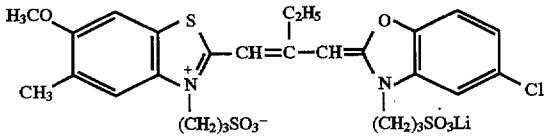
SD-3
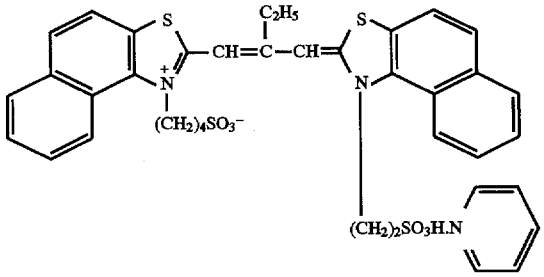
SD-4
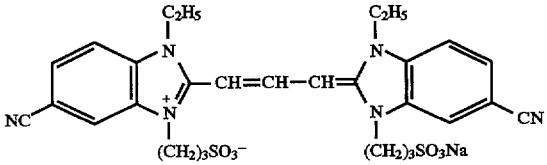
SD-5
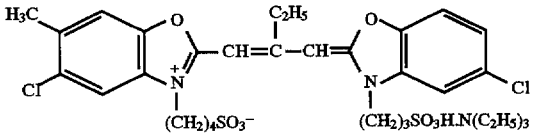

-continued
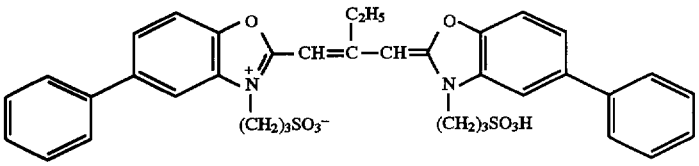
SD-6
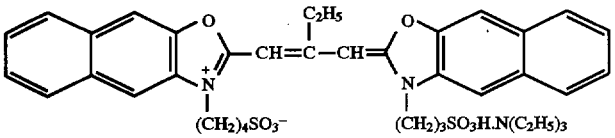
SD-7
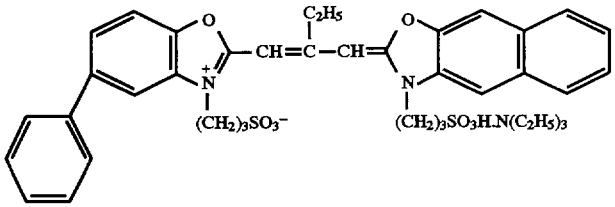
SD-8
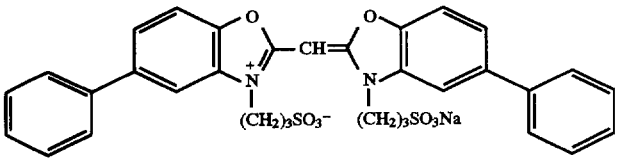
SD-9
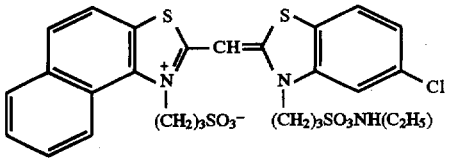
SD-10
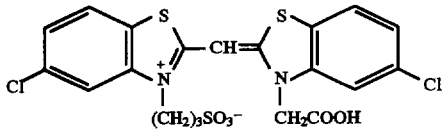
SD-11
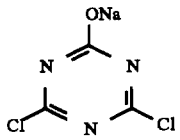
H-1
$(CH_2{=}CHSO_2CH_2)_2O$
H-2
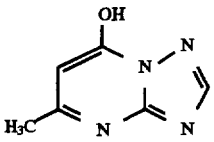
ST-1
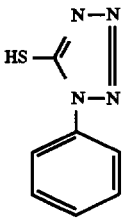
AF-1
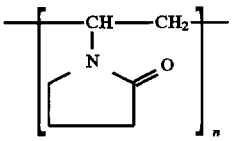
n: Degree of polymerization
AF-2

-continued

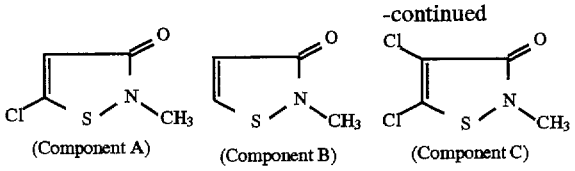

(Component A) (Component B) (Component C)

DI-1 is a mixture of the above-mentioned three components.
Component A:Component B:Component C = 50:46:4 (mol ratio)

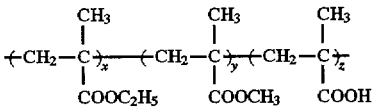

x:y:z = 3:3:4

In the same manner as in light-sensitive material Sample 1, Samples 102–108 were prepared, in which emulsion EM-1 was replaced with EM-2 through EM-8.

TABLE 4

| Sample No. | 102 | 103 | 104 | 105 | 106 | 107 | 108 |
|---|---|---|---|---|---|---|---|
| Emulsion | EM-2 | EM-3 | EM-4 | EM-5 | EM-6 | EM-7 | EM-8 |

The conditions for color developing process are as follows.

| Processing Step | | |
|---|---|---|
| 1. Color developing step | 3 min. and 15 sec. | 38.0 ± 0.1° C. |
| 2. Bleaching step | 6 min. and 30 sec. | 38.0 ± 3.0° C. |
| 3. Washing step | 3 min. and 15 sec. | 24 to 41° C. |
| 4. Fixing step | 6 min. and 30 sec. | 38.0 ± 3.0° C. |
| 5. Washing step | 3 min. and 15 sec. | 24 to 41° C. |
| 6. Stabilizing step | 3 min. and 15 sec. | 38.0 ± 3.0° C. |
| 7. Drying step | | 50° C. or lower |

The composition of processing solutions used in each of the above processing steps were as follows.

| | |
|---|---|
| <Color developing solution> | |
| 4-Amino-3-methyl-N-ethyl-N-(β-hydroxyethyl)aniline sulfate | 4.75 g |
| Sodium sulfite anhydride | 4.25 g |
| Hydroxylamine.½ sulfate | 2.0 g |
| Potassium carbonate anhydride | 37.5 g |
| Sodium bromide | 1.3 g |
| Trisodium nitrilotriacetate (monohydrate) | 2.5 g |
| Potassium hydroxide | 1.0 g |
| Water was added to make 1 liter, and the pH was adjusted to 10.1. | |
| <Bleaching solution> | |
| Ammonium salt of ferric ethylenediaminetetraacetic acid | 100.0 g |
| Diammonium salt of ethylenediaminetetraacetic acid | 10.0 g |
| Ammonium bromide | 150.0 g |
| Glacial acetic acid | 10.0 g |
| Water was added to make 1 liter, and the pH was adjusted to 6.0 using an aqueous ammonia. | |
| <Fixing solution> | |
| Ammonium thiosulfate | 175.0 g |
| Sodium sulfite anhydride | 8.5 g |
| Sodium metabisulfite | 2.3 g |

-continued

| | |
|---|---|
| Water was added to make 1 liter, and the pH was adjusted to 6.0 using acetic acid. | |
| <Fixing solution> | |
| Formalin (a 37% aqueous solution) | 1.5 cc. |
| Koniducks (produced by Konica Corporation) | 7.5 cc. |
| Water was added to make 1 liter. | |

Each of the samples was exposed to green light (G) for sensitometry (1/200") so that their relative speed, graininess and pressure resistance were evaluated.

Samples were subjected to color developing within one minutes after exposure. A sensitivity was shown as a relative value of an inverse of an exposure amount providing a density of Dmin (minimum density)+0.15, base on the sensitivity of Sample 101 being 100 (The larger is the value as compared to 100, the higher the sensitivity is.)

Graininess was shown as a relative value of the standard deviation (RMS value) of the fluctuation of the density value which occurs when a density of Dmin.+0.5 was scanned by a microdensitometer having an aperture scanning area of 250 $\mu m^2$. The smaller the RMS value is, the better the graininess is, showing higher effects. The graininess was shown as a relative value when the RMS value of Sample 101 was defined to be 100 (The smaller the value is compared to 100, the more the graininess is improved.)

For testing pressure resistance, each sample was scanned at a certain speed with a scratch tension tester (produced by Shintoh Kagaku Co., Ltd.) wherein 5 g load was applied on a needle whose curvature radius at the edge was 0.025 mm. Following this, each sample was subjected to exposure to light and photographic processing. At the density of Dmin. and Dmin.+0.4, density variations ΔD1 (Dmin) and Δ2 (Dmin+0.4) of portions where load was respectively applied was measured. Relative pressure resistance was represented by values when ΔD1 and Δ2 of Sample 101 were respectively 100 (the smaller the values are compared to 100, the more each factor was improved).

Results thereof are shown in Table 5.

TABLE 5

| Sample No. | Inv./ Comp. | Relative speed | Graininess | Pressure fogging (ΔD1) | Pressure desensitization (ΔD2) |
|---|---|---|---|---|---|
| 101 | Inv. | 100 | 100 | 100 | 100 |
| 102 | Inv. | 107 | 100 | 95 | 100 |
| 103 | Inv. | 100 | 105 | 103 | 100 |
| 104 | Inv. | 99 | 108 | 106 | 99 |

TABLE 5-continued

| Sample No. | Inv./ Comp. | Relative speed | Graininess | Pressure fogging (ΔD1) | Pressure desensitization (ΔD2) |
|---|---|---|---|---|---|
| 105 | Comp. | 51 | 190 | 207 | 105 |
| 106 | Comp. | 60 | 106 | 108 | 108 |
| 107 | Comp. | 81 | 183 | 105 | 110 |
| 108 | Comp. | 90 | 198 | 104 | 201 |

As is apparent from the results shown by Table 5, Samples 101 through 104 of the present invention containing emulsions of the present invention have high speed and are improved in graininess and pressure resistance. Of these, Sample 102 containing emulsion EM-2 satisfying the best combination of the present invention was particularly superior.

What is claimed is:

1. A silver halide color photographic light sensitive material comprising a support having thereon a silver halide emulsion layer, wherein said silver halide emulsion layer comprises silver halide grains having a variation coefficient of grain size of 20% or less and at least 50% of the total projected area of said silver halide grains is accounted for by tabular grains having an aspect ratio of 5 or more; and said silver halide grains have an average silver iodide content of 4 mol % or more and comprising:

(1) a core portion having a silver iodide content of 15 mol % or less (2) a shell portion having a silver iodide content of 8 mol % or more, and (3) a surface phase having a silver iodide content higher than the average silver iodide content, and wherein said silver halide grains have a distinct core/shell structure.

2. The silver halide photographic material of claim 1, wherein, when a diffraction pattern of a (420) face of said silver halide grains is measured with an X-ray diffractometer using K α ray of Cu, said silver halide grains provide an X-ray diffraction pattern having a signal with two maximums comprising a diffraction peak corresponding to the core part and a diffraction peak corresponding to the shell part and a minimum between the two peaks; and a ratio of a diffraction intensity of the minimum to that of the maximum with a lower intensity of the two maximums is 0.9 or less.

3. The silver halide photographic material of claim 2, wherein the ratio of a diffraction intensity of the minimum to a diffraction intensity of the maximum with a lower intensity of the two maximums is 0.7 or less

4. The silver halide photographic material of claim 1, wherein a diffraction peak intensity corresponding to the shell part is 1/1 to 20/1 of that of the core part.

5. The silver halide photographic material of claim 4, wherein a diffraction peak intensity corresponding to the shell part is 2/1 to 15/1 of that of the core part.

6. The silver halide photographic material of claim 1, wherein said tabular grains have an average thickness of 0.07 to 0.5 μm.

7. The silver halide photographic material of claim 1, wherein the silver iodide content of the shell portion is higher than that of the core portion.

8. The silver halide photographic material of claim 1, wherein said surface phase has a thickness of 50 Å from the grain surface.

9. The silver halide photographic material of claim 1, wherein a ratio of the silver iodide content of the surface phase to the average silver iodide content is 1.5 to 30.

10. The silver halide photographic material of claim 1, wherein said silver halide grains are prepared by a process comprising:

preparing seed grains, introducing, into a reaction vessel containing an aqueous protective colloid solution and the prepared seed grains, silver and halide ions, and, optionally, silver halide fine grains so as to cause the seed grains to grow to form the core portion on the seed grain and further thereon, the shell portion, and maintaining a pAg value within the reaction vessel during grain growth at 7.0 to 11.0.

11. The silver halide photographic material of claim 10, wherein the pAg is maintained at 7.5 to 10.5.

12. The silver halide photographic material of claim 11, wherein the pAg is maintained at 8.0 to 10.0.

* * * * *